United States Patent [19]

Brochand

[11] Patent Number: 4,691,643

[45] Date of Patent: Sep. 8, 1987

[54] ROPE COUPLING CARRIAGE HAVING CONCAVE TRACK BETWEEN GRIPS

[75] Inventor: Max Brochand, Noyarey, France

[73] Assignee: Pomagalski, Fontaine, France

[21] Appl. No.: 903,238

[22] Filed: Sep. 3, 1986

[30] Foreign Application Priority Data

Sep. 9, 1985 [FR] France ..... 85 13450

[51] Int. Cl.[4] ..... B61B 12/12

[52] U.S. Cl. ..... 104/202; 104/211; 104/216; 104/209; 104/204

[58] Field of Search ..... 104/200, 202–205, 104/207–214, 216–218, 173.1, 173.2; 105/148, 150

[56] References Cited

U.S. PATENT DOCUMENTS

| | | | |
|---|---|---|---|
| 2,250,339 | 7/1941 | Whittum | 104/200 |
| 3,037,464 | 6/1962 | Penney | 104/209 |
| 3,610,164 | 10/1971 | Feuz | 104/211 X |
| 4,297,951 | 11/1981 | Laurent | 104/209 |
| 4,573,414 | 3/1986 | Cantin et al. | 104/202 |

FOREIGN PATENT DOCUMENTS

| | | | |
|---|---|---|---|
| 0685443 | 4/1964 | Canada | 104/200 |
| 2355317 | 5/1975 | Fed. Rep. of Germany | 104/211 |
| 1455899 | 10/1966 | France | 104/202 |
| 2270134 | 12/1975 | France . | |
| 2506245 | 11/1982 | France . | |
| 0629714 | 5/1982 | Switzerland . | |

*Primary Examiner*—Robert B. Reeves
*Assistant Examiner*—Scott H. Werny
*Attorney, Agent, or Firm*—Parkhurst & Oliff

[57] ABSTRACT

A carriage coupling cars to a carrier-hauling rope of a cable-car comprises two grips having protruding parts above the upper face of the rope. A connecting part with a concave running face facilitating the passage of the grips under the compression sheaves extends between the protruding parts.

6 Claims, 6 Drawing Figures

ROPE COUPLING CARRIAGE HAVING CONCAVE TRACK BETWEEN GRIPS

TECHNICAL FIELD

The invention relates to a carriage coupling loads, notably cars or chairs, to an aerial rope of a transport installation having support and compression sheave batteries of said rope, spaced out along the line, said carriage having two grips set apart, each one gripping the rope by means of a pair of jaws, mounted astride the rope with a protruding part of limited thickness above the upper face of the rope for the grip to pass easily under the compression sheave batteries, said protruding part being extended on both sides in the direction of the rope by a running track to facilitate entry and exit of the grip under a compression sheave.

BACKGROUND OF THE INVENTION

A state-of-the-art carriage of the kind mentioned comprises a flexible bar of a thickness equal to that of the protruding parts of the grips, this bar being located on the upper face of the rope gripped by the grips, in the gap between the two protruding parts. This avoids a sheave dropping, when the grips pass under a compression sheave after the protruding part of the first grip has been passed, and then being forced upwards by the protruding part of the second grip of the carriage. The flexibility of the bar enables the latter to follow the curvature of the rope while remaining flat on the rope. This device reduces vibrations and shocks when passing a compression sheave battery, but this passage remains noisy and uncomfortable.

The object of the present invention is to produce a perfected carriage, whose passage under the compression sheave batteries is made easier. It is based on the observation that shocks result from a part starting to move or stopping moving, this shock being more violent the greater the mass moved and the higher the speed.

SUMMARY OF THE INVENTION

The carriage according to the invention is characterized by the fact that the running track, located between the two grips, presents at both ends a maximum thickness appreciably equal to that of said protruding part so as just to reach the same level as the protruding part above the rope in the grip connection area and a general upward-facing concave shape with a minimum thickness in the middle between the two grips.

Holding a section of the rope captive between the two grips of the carriage increases the rigidity of this section and the concave shape of the running track compensates for this rigidity by presenting the compression sheave with a similar curvature to that of the free rope. This compensation is particularly advantageous in the case of a carriage with rigidly fixed grips connected by a rigid bar fitted between the two protruding parts, but it also has advantages for a flexible bar.

The concave shape gives a descending ramp, followed by an ascending ramp. By choosing the appropriate length for these ramps, depending on the distance between the successive compression sheaves and in combination with the ramps formed by the needles on entry and exit of the carriage, it is possible to reconstitute the simple rocking of the sheave battery, whose spindle remains practically immobile when the grip passes, commonly used for a single grip. The distance between the two grips is advantageously close to twice that separating two successive sheaves.

The invention can essentially be applied to single-rope transporters of the detachable cable-car or chairlift type, but it can also be used for fixed grips or for other installations.

BRIEF DESCRIPTION OF THE DRAWINGS

Other advantages and characteristics will become more clearly apparent from the following description of an embodiment of the invention, given as an example only and represented by the accompanying drawings, in which.

DETAILED DESCRIPTION OF THE PREFERRED EMBODIMENT

Figure 1:
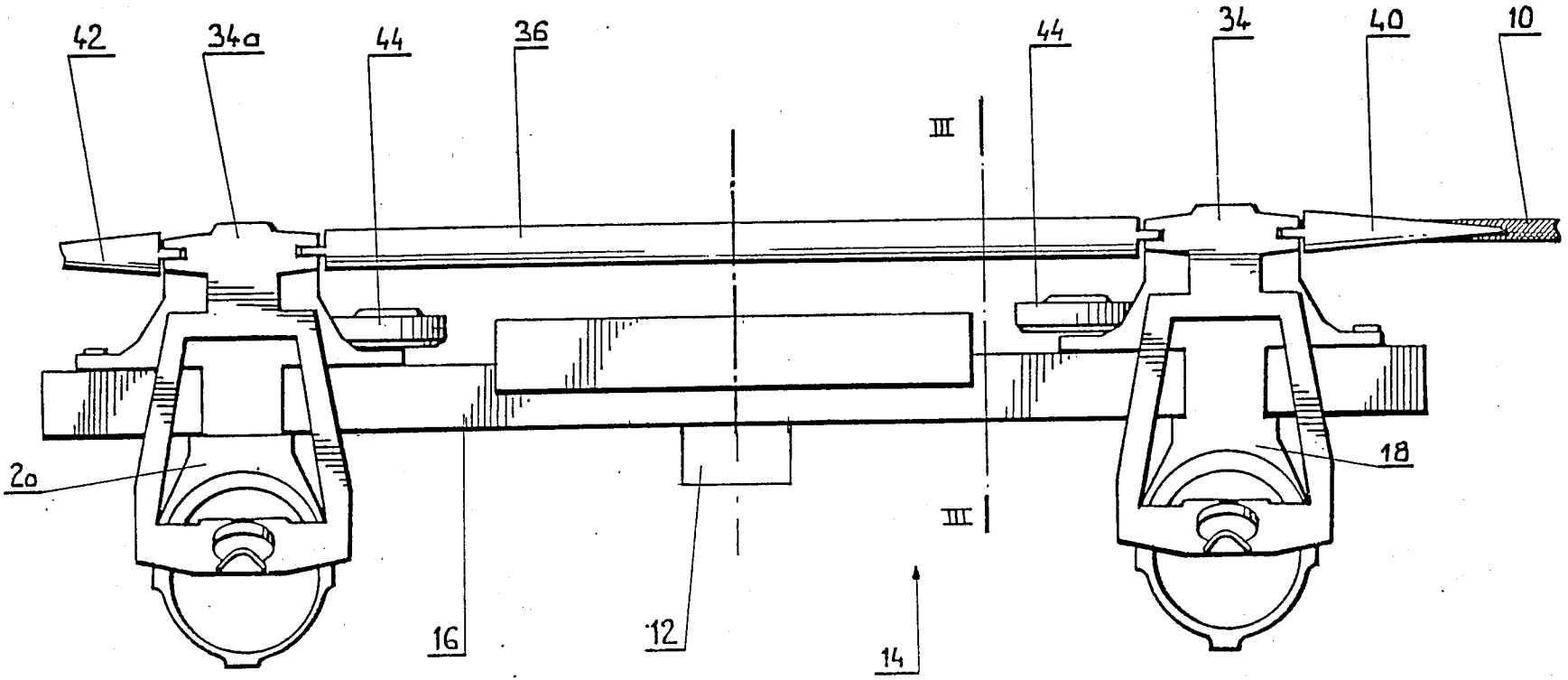
FIG. 1 is a schematic plan view of a carriage according to the invention.
Figure 2:
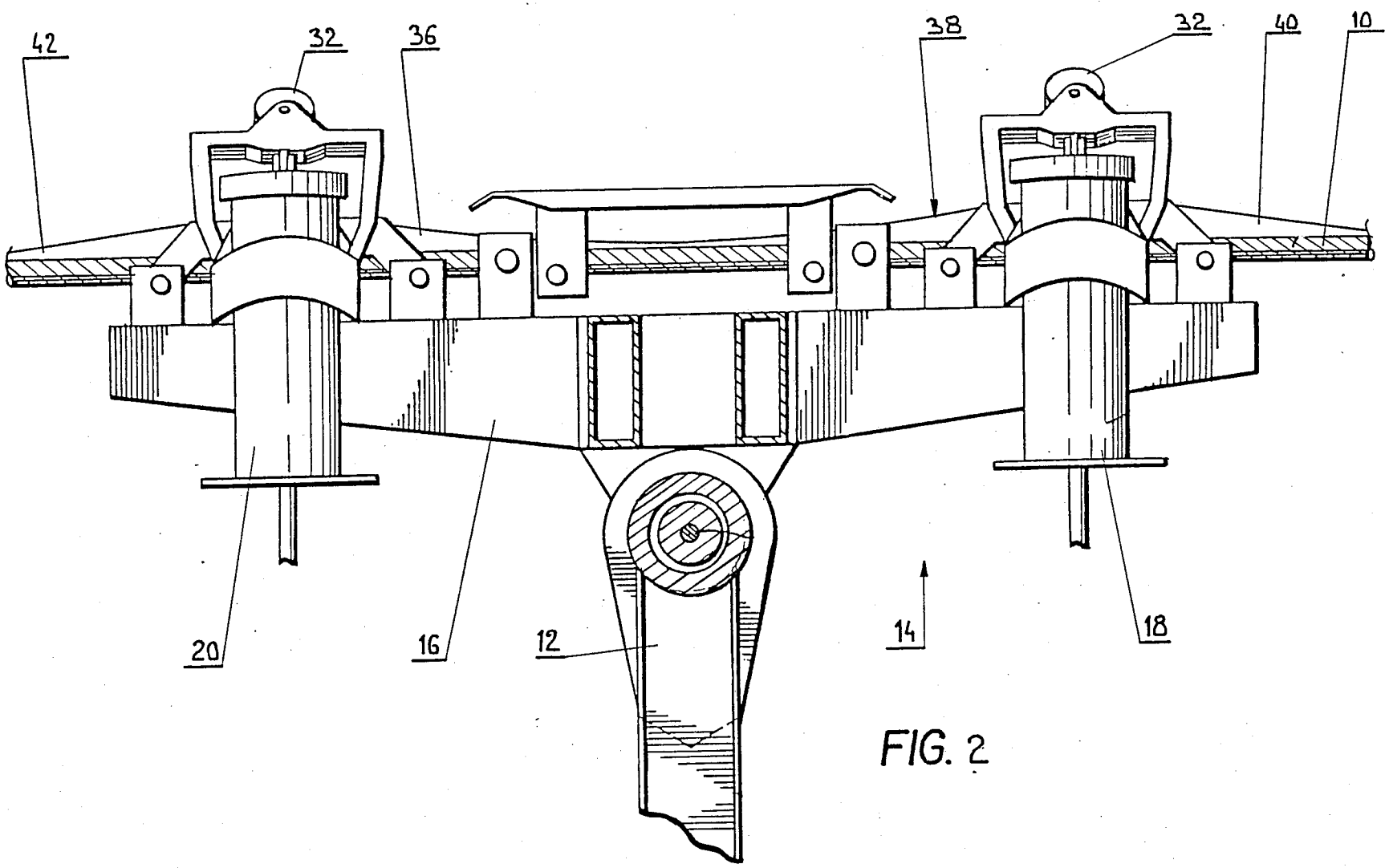
FIG. 2 is an elevational view of the carriage according to FIG. 1.
Figure 3:
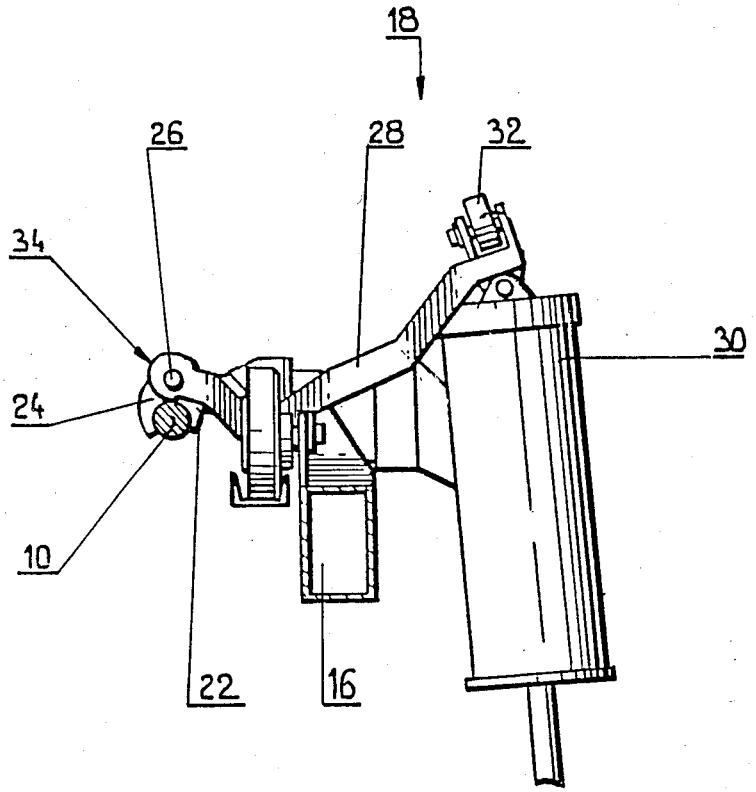
FIG. 3 is a sectional view according to the line III—III of FIG. 1.

In the figures, a rope 10 of a detachable cable-car or chairlift extends between two terminals, in which the cars or chairs are detached from the rope 10 for unloading and/or loading at low speed or at a standstill. Each car or chair is fixed by a hanger arm 12 to a carriage 14 coupling it to the carrier-hauling rope 10. The frame 16 of the carriage 14 bears two grips 18, 20 gripping the rope 10 at two spaced apart points, when the carriage 14 is coupled to the rope 10. The grips 18, 20 are identical, for example of the kind described in U.S. Pat. No. 4,441,430 and a reminder of their main features only is given here. Each grip comprises a pair of jaws 22, 24 with an articulation spindle 26, located above the rope 10, gripped between the jaws. The fixed jaw 22 is securedly united to the frame 16, whereas the moving jaw 24 is borne by a control lever 28, extending on the opposite side from the spindle 26. The lever 28 is biased in the closed position of the grip by a spring 30 and is controlled by a roller 32, cooperating with a control rail (not shown) to open the grip when the carriage 14 passes. The jaws 22, 24 are mounted astride the rope 10, just reaching or slightly above the lower face of the rope 10 for a contact-free passage over the support sheaves of the rope 10. The jaws 22, 24 form a protruding part 34 above the upper face of the rope 10 at the level of the spindle 26. A connecting bar 36 extends between the protruding parts **34, 34*a* of the two grips 18, 20, the face 38 of the connecting bar 36 opposite the rope 10 forming a running track. In the embodiment illustrated in the figures, the grips 18, 20 are rigidly fixed to the frame 16 and the connecting bar 36 is rigid and fixed to the protruding parts 34, 34*a* by its ends. Needles 40, 42 in the form of a ramp extend the protruding parts 34, 34*a* on the opposite side from the connecting bar 36. The carriage 14 comprises sheave batteries 44 for running on transfer rails in the terminals, after it has been detached from the rope 10**.

Figure 4:
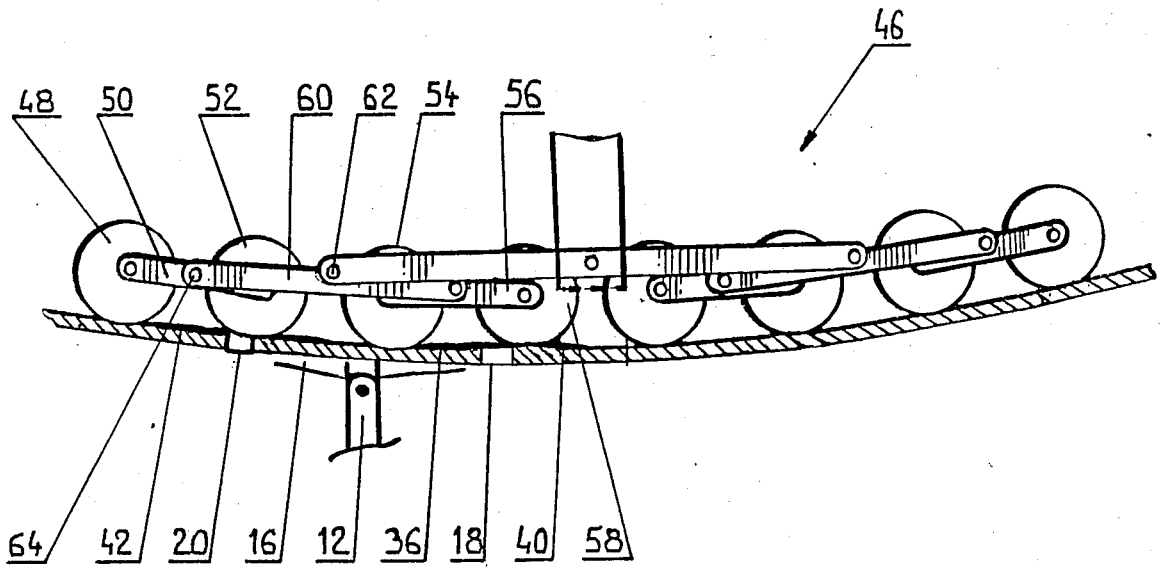
FIG. 4 is a view illustrating the carriage passing under a compression sheave battery.

Referring more particularly to FIG. 4, it can be seen that, when the carriage 14 passes under a compression sheave battery 46, the needle 40 raises the first sheave of the first elementary sheave battery 50 up to the same level as the protruding part 34, this sheave 48 then running on the track 38 of the bar 36 before passing over the protruding part 34*a* and coming down onto the needle 42. At the same time, the needle 40 engages the second sheave 52 of the first elementary sheave battery 50, then the first sheave 54 of the second elementary sheave battery 56 and the second sheave 58 of this second sheave battery and so on, in a manner well known in the art. The two elementary sheave batteries 50, 56 are articulated by means of spindles 64, 66 on a main sheave battery 60, pivotally mounted at its center 62.

Figure 5:
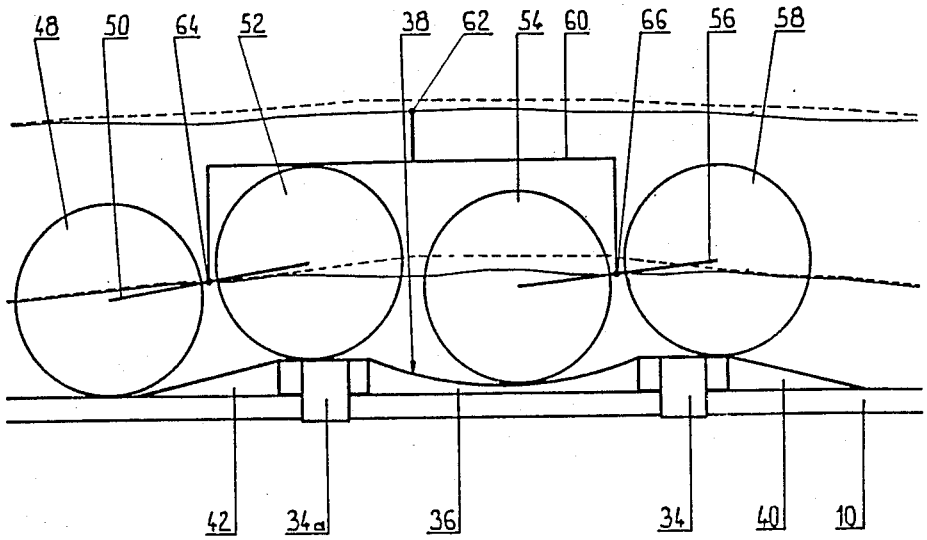
FIG. 5 is a detailed view of FIG. 4, on an enlarged scale, showing the carriage passing under a flat compression sheave battery.

According to the invention, the connecting bar 36 presents a thickness equal to that of the protruding parts 34, 34*a* at its ends to avoid a continuity solution, the central part of the bar 36 being thinner or of zero thickness, so as to create a concave or sunken running surface 38 which cooperates with the compression sheaves. The assembly is arranged in such a way that the two sheaves of any one battery are never raised or lowered at the same time when a carriage passes, one advantageously running on a descending track whereas the other one runs on an ascending track or ramp. The articulation point 64, 66 of the sheave battery 50, 56 thus remains appreciably immobile, movement being limited to pivoting of the sheave battery. This compensation effect results from the length of the needles 40, 42 and from that of the connecting bar 36 in relation to the distance between two successive compression sheaves. In FIG. 5, it can be seen that the second sheave 52 will start its downward movement on the track 38 at the moment the first sheave 48 reaches the needle 42. The length of this needle 42 is appreciably equal to the distance between the sheaves 48, 52. Similarly, the distance between the protruding parts 34, 34*a* is approximately twice the distance between the sheaves 48, 52. In order to illustrate the limited movement of the spindles 64, 66, 62 of the sheave batteries 50, 56, 60, the carriage 14 is assumed to be immobile, the sheave batteries moving in the direction of the rope 10, and the trajectory of the spindles 64, 66, 62 has been represented by a bold line in FIG. 5. For comparison purposes, the corresponding trajectory in the case of a straight connecting bar 36 is represented by the dashed line.

Figure 6:
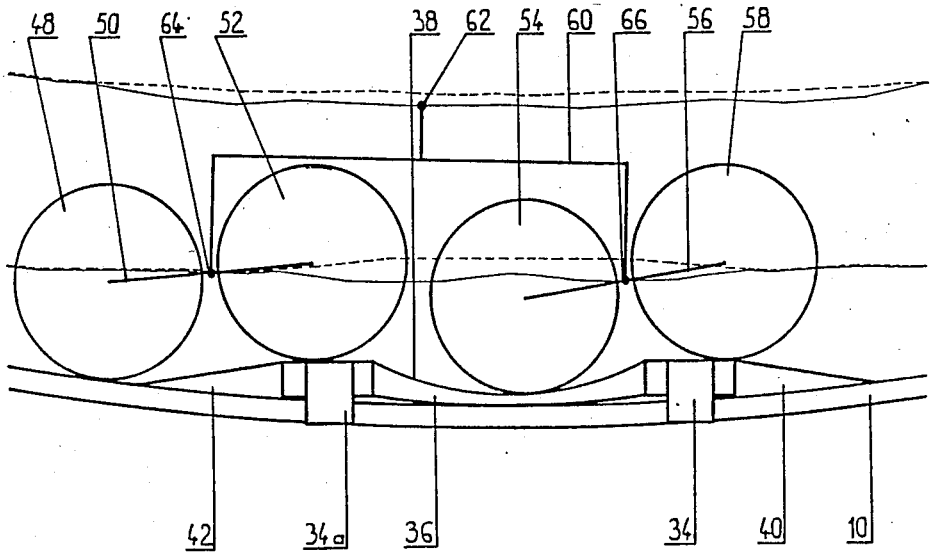
FIG. 6 is a similar view to that of FIG. 5, showing the carriage passing under a loaded compression sheave battery.

FIG. 6, similar to FIG. 5, shows the carriage 14 passing under a loaded compression sheave battery, imposing a downward curvature on the rope 10. The curvature of the connecting bar 36 in this case partially couteracts the rigidity of the carriage 14 and enables the amplitudes of movement of the spindles 64, 66, 62 of the sheave batteries to be limited by simulating a curvature of the carriage 14, whichfollows that of the rope 10. It is obvious that the limited movements, caused by the carriage passing under the compression sheave batteries, make this passage easier and limit vibrations, which are noisy and cause wear.

The invention may be applied to a carriage, equipped with grips articulated on the frame, to follow the curvatures of the rope, the connecting bar being in this case flexible. The lower compensation is not negligible and enables passenger comfort to be increased. The curved connection according to the invention may be used for any grip having two protruding parts or protuberances spaced out along the rope.

What I claim is:

1. A carriage, coupling loads, notably cars, to an aerial rope of a transport installation having support and compression sheave batteries with successive sheaves separated by a first distance along a line formed by said rope, said carriage comprising two grips set apart by a second distance, each grip having a pair of jaws mounted astride and gripping the rope with a protruding part of limited thickness above an upper face of the rope for the grip to pass easily under the compression sheave batteries, and a running track extending said protruding part on both sides thereof on the rope, to facilitate entry and exit of the grip under a compression sheave, a part of the running track located between the two grips presenting at both ends a maximum thickness appreciably equal to the thickness of said protruding part so as to just reach the same level as the protruding part above the rope in the grip connection area and a general upward-facing concave shape with a minimum thickness in a middle portion between the two grips.

2. A carriage according to claim 1, wherein the protruding part of a grip is extended to a front and to the rear of the carriage by a running track forming a ramp of a length close to the first distance between two successive sheaves of a compression sheave battery.

3. A carriage according to claim 1, wherein the second distance between two grips is close to twice the first distance between two successive sheaves of a compression sheave battery.

4. A carriage according to claim 1, wherein the running track between the two grips is constituted by a connecting part between the grips bearing on the upper face of the rope.

5. a carriage according to claim 4, wherein the grips are rigidly attached to the carriage, said connecting part extending rigidly between the protruding parts of the two grips.

6. A carriage according to claim 4, wherein the grips are pivotally mounted on the carriage to follow curvatures of the rope, said connecting part being flexible.

* * * * *